US011701538B2

(12) United States Patent
Pallesen et al.

(10) Patent No.: US 11,701,538 B2
(45) Date of Patent: Jul. 18, 2023

(54) AQUATIC EXERCISE DEVICE

(71) Applicant: Aqua Group Limited, Auckland (NZ)

(72) Inventors: John Douglas Pallesen, Auckland (NZ); Robert Delaney Tucker Mitchell, La Jolla, CA (US); Steven J. Kennedy, San Diego, CA (US)

(73) Assignee: Aqua Group Limited, Auckland (NZ)

( * ) Notice: Subject to any disclaimer, the term of this patent is extended or adjusted under 35 U.S.C. 154(b) by 0 days.

(21) Appl. No.: 17/513,951

(22) Filed: Oct. 29, 2021

(65) Prior Publication Data

US 2022/0134162 A1 May 5, 2022

Related U.S. Application Data

(60) Provisional application No. 63/130,523, filed on Dec. 24, 2020.

(51) Int. Cl.
*A63B 21/008* (2006.01)
*A63B 21/00* (2006.01)

(52) U.S. Cl.
CPC .... *A63B 21/0084* (2013.01); *A63B 21/00065* (2013.01); *A63B 21/4035* (2015.10); *A63B 2208/03* (2013.01); *A63B 2209/10* (2013.01)

(58) Field of Classification Search
CPC ..... A63B 15/00; A63B 21/0004; A63B 21/00061; A63B 21/00065; A63B 21/0084; A63B 21/4035; A63B 21/4043; A63B 2208/03; A63B 2209/10; A63B 2225/60
See application file for complete search history.

(56) References Cited

U.S. PATENT DOCUMENTS

| | | | | | |
|---|---|---|---|---|---|
| 3,809,397 | A | | 5/1974 | Gruenewald | |
| 4,416,451 | A | * | 11/1983 | Solloway | A63B 21/00061 482/44 |
| 4,468,023 | A | | 8/1984 | Solloway | |
| 4,623,142 | A | * | 11/1986 | MacKechnie | A63B 23/03508 482/111 |
| 4,973,049 | A | * | 11/1990 | Ciolino | A63B 21/00065 441/59 |
| 4,988,094 | A | * | 1/1991 | Beasley | A63B 23/03508 482/111 |
| 5,033,739 | A | * | 7/1991 | MacKechnie | A63B 21/0084 482/111 |
| 5,531,657 | A | | 7/1996 | Macedo | |

(Continued)

FOREIGN PATENT DOCUMENTS

| | | | |
|---|---|---|---|
| WO | 2012015390 | A1 | 2/2012 |
| WO | 2015179897 | A1 | 12/2015 |

*Primary Examiner* — Joshua Lee
(74) *Attorney, Agent, or Firm* — Cahn & Samuels, LLP

(57) ABSTRACT

An aqua-resistance exercise device includes an elongate member, a strap, fasteners, and one or more fins. The elongate member includes an engagement portion, a shaft extending from the engagement portion, and a handle to be gripped by a user. The fasteners are provided to the engagement portion of the elongate member and an inner side of the strap to releasably attach the strap to the engagement portion of the elongate member. The one or more fins are adapted to be received on the strap, and the fasteners releasably secure the strap to the engagement portion of the elongate member to thereby releasably secure the fins to the elongate member.

20 Claims, 10 Drawing Sheets

(56) References Cited

U.S. PATENT DOCUMENTS

| | | | | |
|---|---|---|---|---|
| 5,766,116 | A * | 6/1998 | Weissbuch | A63B 21/0084 D21/678 |
| 6,325,727 | B1 | 12/2001 | Carr | |
| 7,090,618 | B2 | 8/2006 | Stout et al. | |
| 7,699,759 | B1 * | 4/2010 | Page | A63B 21/00065 482/111 |
| 7,727,123 | B2 | 6/2010 | Stout et al. | |
| 10,870,032 | B2 * | 12/2020 | Bardakci | A63B 21/0004 |
| 2004/0097342 | A1 * | 5/2004 | Stout | A63B 21/0004 482/55 |
| 2004/0116256 | A1 * | 6/2004 | Stout | A63B 21/4043 482/55 |
| 2005/0215339 | A1 * | 9/2005 | Namba | A63B 21/0088 473/228 |
| 2009/0227400 | A1 | 9/2009 | Winger | |
| 2014/0113752 | A1 * | 4/2014 | Westcott | A63B 69/3632 473/422 |

* cited by examiner

AQUATIC EXERCISE DEVICE

FIELD OF INVENTION

The present invention relates to aqua exercise equipment, and specifically to aqua exercise equipment that may be used in water to replicate movement employed when using hand-held sporting equipment for resistance training and exercises in water.

BACKGROUND TO THE INVENTION

The use of aqua resistance equipment may be used to increase the resistance that water provides against a user's movement in water to improve strength and aerobic fitness and other related benefits, while avoiding land based disadvantages caused by gravity acting on the body when performing exercises.

Aqua exercise resistance equipment may be difficult to use. For example, aqua exercise resistance equipment may not provide a correct or desired level of resistance against movement in water. Also, equipment can be difficult for a user to attach, or to adjust for use by different people, or to adjust to create different levels of resistance for one person to satisfy a personal training regime.

Existing aqua resistance products may not target specific muscle groups associated with specific sporting activities that use hand-held equipment such as bats, rackets, clubs, paddles and the like. Equipment that is designed to target specific muscle groups may not be configurable for a desired resistance level, and/or may not be easily configurable for a desired resistance level to meet a particular training regime. Resistance levels in use can be significant and therefore require robust connection of water resistance component to handles and the like. Achieving robust connections while also providing ease of adjustment, for example during a training session, is desirable.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

OBJECT OF THE INVENTION

It is an object of at least one embodiment of the present invention to provide an improved aqua exercise device that addresses one or more of the above-mentioned disadvantages, or to at least provide the industry or the public a useful choice.

SUMMARY OF THE INVENTION

According to a first aspect of the invention, there is provided an aqua resistance exercise device comprising:

an elongate member comprising an engagement portion, a shaft extending from the engagement portion, and a handle to be gripped by a user;

a strap; and fasteners provided to the engagement portion of the elongate member and an inner side of the strap to releasably attach the strap to the engagement portion of the elongate member; and one or more fins adapted to be received on the strap;

wherein the fasteners releasably secure the strap to the engagement portion of the elongate member to thereby releasably secure the fins to the elongate member.

In some embodiments, the fasteners releasably attach the strap to the engagement portion of the elongate member along substantially a full length of the strap.

In some embodiments, the fasteners are hook and loop type fasteners.

In some embodiments, the hooks or loops of the hook and loop fasteners is applied over substantially the full surface of the inner side of the strap, and the other of the hooks and loops is applied over substantially the full surface of the engagement portion of the elongate member.

In some embodiments, the length of the strap is longer than a circumference of the engagement portion of the elongate member so that one end of the strap overlaps an opposite end of the strap when the strap is wrapped around and attached to the engagement portion of the elongate member. A first fastener is provided to an inner side of the strap, and a corresponding opposite second fastener is provided to an outer side of the strap, so that the inner side of an overlapping portion of the strap is releasably attached to the outer side of the strap when the strap is wrapped around and attached to the engagement portion of the elongate member.

In some embodiments, the first fastener is hooks or loops of hook and loop fasteners and the second fastener is corresponding loops or hooks of the hook and loops fasteners.

In some embodiments, the hooks or loops of the hook and loop fasteners is applied over substantially the full surface of the inner side of the strap, and the other of the hooks and loops is applied over substantially the full surface of the outer side of the strap.

In some embodiments, the engagement portion of the elongate member has an enlarged diameter portion with a diameter larger than a diameter of the shaft.

In some embodiments, the engagement portion comprises a lateral profile presenting a plurality of sides. In some embodiments the sides are equi-spaced around a longitudinal axis of the engagement portion.

In some embodiments, each side presents a position for securing a respective fin.

In some embodiments, each fin has a base with a width corresponding substantially to a width of a side of the engagement portion.

In some embodiments, each fin has a base having a shape commensurate with a shape of a side of the engagement portion In some embodiments, the device comprises a plurality of fins, and wherein the strap, engagement portion of the elongate member and the fasteners are configured so that one fin of the plurality of fins may be attached to the elongate member, and all fins of the plurality of fins may be attached to the elongate member, such that a user may chose a number of fins from the plurality of fins to attach to the elongate member to provide a desired resistance level.

In some embodiments, each fin comprises a base and a longitudinal fin extending from the base, and wherein the base comprises a first aperture and a second aperture spaced apart in a longitudinal direction of the strap, so that the strap passes through the first aperture and the second aperture to receive the fin on the strap.

In some embodiments, the base comprises a first lateral side member, a central lateral member and a second lateral side member, the first aperture positioned between the first lateral side member and the central lateral side member, and the second aperture positioned between the central lateral member and the second lateral side member. A relative position of the central lateral member to the first and second lateral side members causes the outer strap to bend across the central lateral member so that the inner surface of the strap is proud of an inner surface of each of the first and second lateral side members to secure the strap to the engagement portion of the elongate member by said fasteners located between the first and second lateral side members.

In some embodiments, the strap is completely separable from the engagement portion of the elongate member.

In some embodiments, the strap is substantially non-extendable.

The shaft may replicate the shaft of an item of sporting equipment, such as a golf club, bat, racket and the like and may be of a similar length to the shaft of the replicated sporting equipment.

According to a second aspect of the invention, there is provided a kit of parts for an aqua-resistance exercise device comprising:

an elongate member comprising an engagement portion, a shaft extending from the engagement portion, and a handle to be gripped by a user;

a strap; and fasteners provided to the engagement portion of the elongate member and an inner side of the strap to releasably attach the strap to the engagement portion of the elongate member; and one or more fins adapted to be received on the strap;

wherein the fasteners releasably secure the strap to the engagement portion of the elongate member to thereby releasably secure the fins to the elongate member.

The kit of parts may comprise a range of different fin sizes, each to provide a different resistance level in water.

The kit of parts may include any one or more of the features described in relation to the first aspect of the invention.

Further aspects of the invention, which should be considered in all its novel aspects, will become apparent to those skilled in the art upon reading of the following description which provides at least one example of a practical application of the invention.

To avoid any doubt, in this specification and claims, the term "diameter" is not limited to the diameter of a circular body such as a cylinder, but is understood to mean a straight line passing from side to side of any body through its center regardless of the shape of the body. For example, a diameter of an elongate rod with a square cross-section is a straight line passing from one side of the rod to an opposite side of the rod through a longitudinal centreline of the rod. The shortest diameter of an elongate rod with a square cross-section has a length equal to the length of one side of the square cross-section. The longest diameter of a rod with a square cross-section has a length equal to the distance between opposed corners of the square cross-section.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

Further aspects and advantages of the present invention will become apparent from the ensuing description which is given by way of example only.

BRIEF DESCRIPTION OF THE DRAWINGS

Further aspects of the present invention will become apparent from the ensuing description which is given by way of example only and with reference to the accompanying drawings in which.

DESCRIPTION OF EMBODIMENTS OF THE INVENTION

Figure 1:
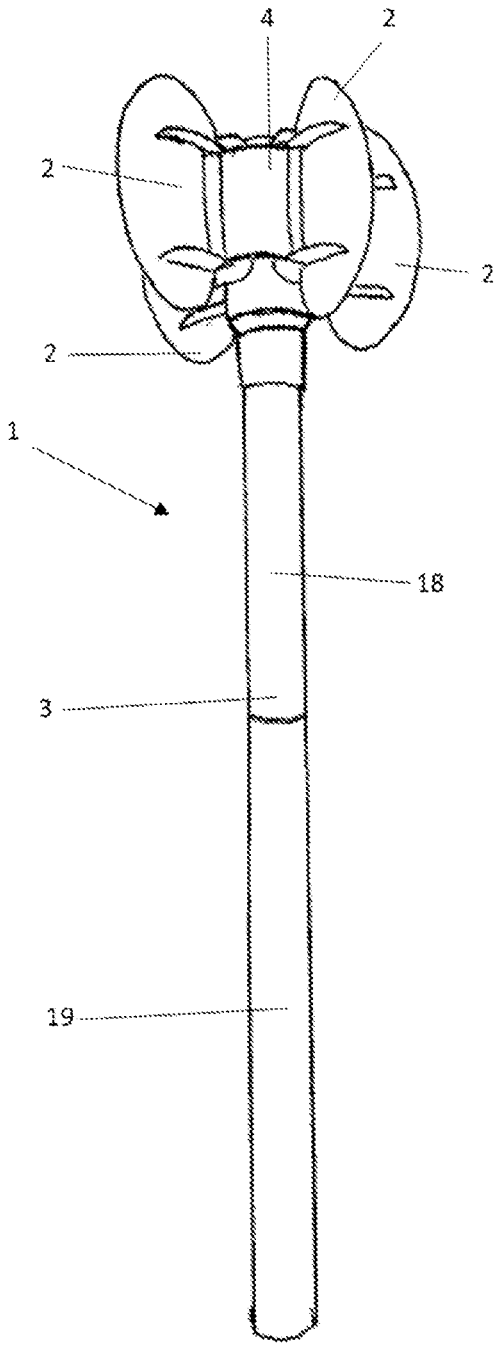
FIG. 1. shows an aqua resistance exercise device according to a first embodiment of the present invention.
Figure 2:
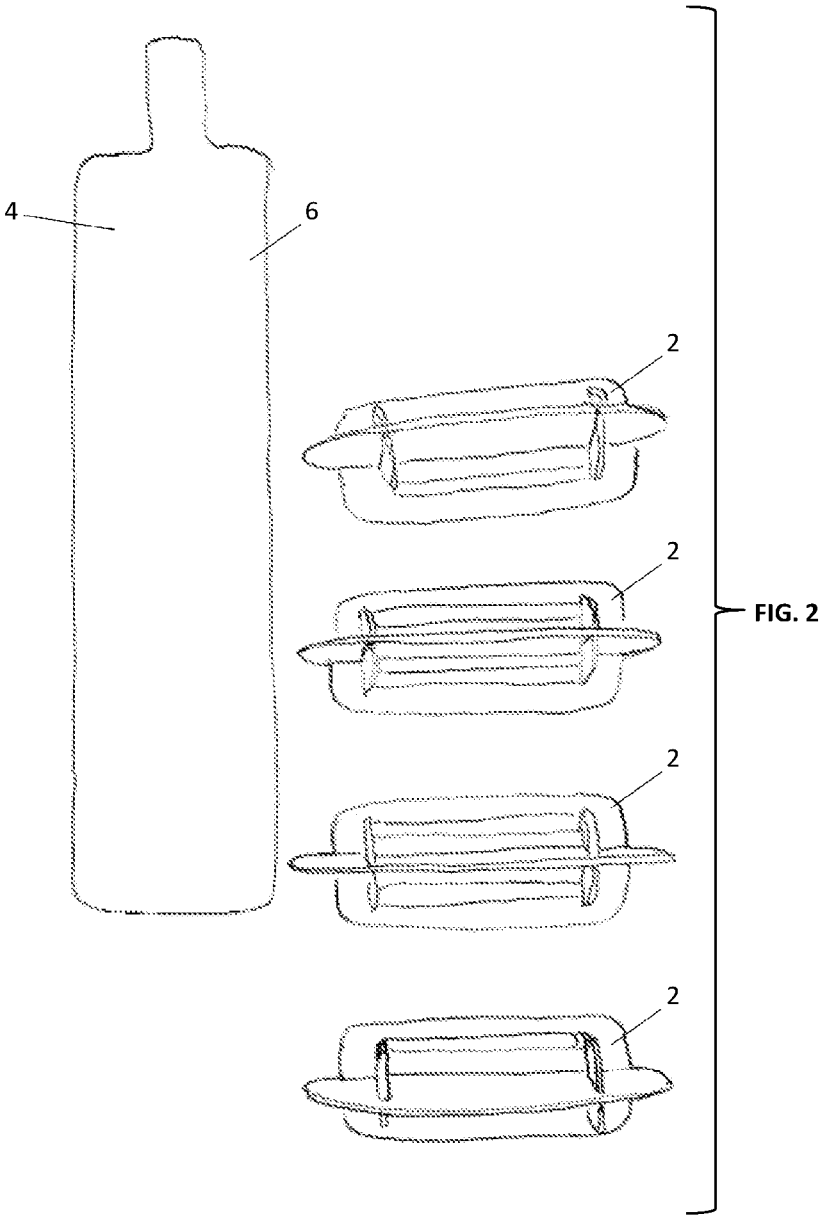
FIG. 2 shows a strap and a plurality of fins of the device of FIG. 1, with the fins disassembled from the strap.
Figure 3:
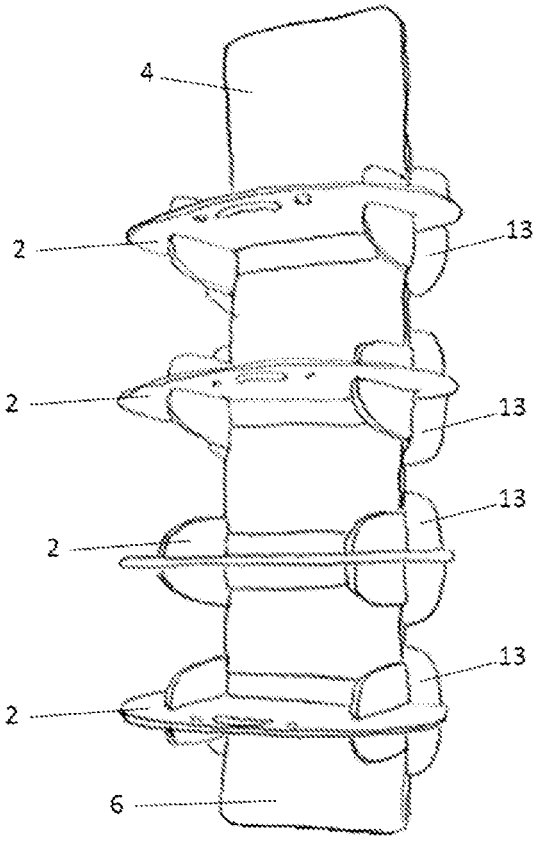
FIG. 3 shows the strap and the plurality of fins of the device of FIG. 1, with the fins received on the strap.

An aqua resistance device according to a first embodiment of the invention is described with reference to FIGS. 1 to 9. The device 1 is configured to be used in water to replicate a motion employed when playing a particular sport. For example, the illustrated device 1 is configured to be used in water to replicate a golf club. A user may swing or move the device 1 in water to replicate the motion of a golfer swinging a golf club. The added resistance to the movement of the device 1 through water provided by water acting on the device 1 as it is moved through water is useful in the development in strength, conditioning and/or rehabilitation of specific muscle groups utilized in the playing of the particular sporting activity.

The device 1 comprises one or more fins 2 releasably attached to an elongate member 3 forming a shaft to replicate the shaft of a handheld item of sporting equipment. Releasable attachment of the fins 2 to the elongate member 3 enables the device 1 to be configurable so that a user may select one or more fins 2 to be attached to the shaft to provide a range of resistance levels to suit the user's requirements for exercising. Alternatively, or additionally different sized fins 2 may be selected to provide a desired resistance level.

An exercise device 1 according to the present invention comprises a strap 4. A plurality of fins 2 are releasably received on the strap 4. In the illustrated embodiment, a maximum of four fins 2 may be received on the strap 4. However, in some embodiments, the maximum number of fins may be less than four or more than four. A resistance level may be set by providing, one or more fins 2 up to the maximum number of fins 2 on the strap 3.

The device 1 includes fasteners to secure the strap 4 to the elongate member 3. Securement of the strap 4 to the elongate member 3 secures the fins 2 to the elongate member 3. Once the fins 2 are received on the strap 4, the strap 4 is secured to the elongate member 3 to secure the fins 2 to the elongate member 3. Once secured to the elongate member, relative movement between the fins and the strap is substantially prevented so that the fins do not move relative to the elongate member during use.

The fasteners secure an inner surface of the strap 4 to an outer surface of the elongate member 3. The fasteners secure the strap to the elongate member along the length of the strap and around a circumference or outer surface of the elongate member.

In the illustrated embodiment, the fasteners are hook and loop type fasteners such as Velcro®. One half (e.g. the hook half or the loop half) of the hook and loop fasteners is applied over substantially the full surface (i.e. at least 90% of the entire surface) of the inner side of the strap (inner side 5 shown in FIG. 5), and the other half of the hook and loop fasteners is applied over substantially a full surface (i.e. at least 90% of the entire surface) of an engagement portion (7 in FIG. 9) of the outer surface of the elongate member 3. The engagement portion of the elongate member corresponds to a surface of the elongate member that the strap covers when the strap is attached to the elongate member. For example, a strip of the hook or loop fasteners is permanently fixed to the engagement portion of the outer surface of the elongate member, to attach to a corresponding strip of loop or hook fasteners on the inner side of the strap.

To secure the strap to the elongate member, the strap is wrapped around the engagement portion of the elongate member to engage the fasteners together. By example, in the illustrated embodiment, the fasteners include hooks 8 attached to the inner surface 5 of the strap 4, and loops 9 attached to the engagement portion 7 of the elongate member.

Other fastener arrangements may be used, for example fasteners that have a female half or connector part and a male half or connector part, such as in a snap fastener comprising male and female interlocking parts, where a plurality of such fasteners is applied with the fasteners spaced apart along the length of the strap and around the engagement portion of the elongate member.

With the fins 2 received on the strap 4, attachment of the strap 4 to the engagement portion of the elongate member secures a base 13 of the fins 2 between the strap 4 and the elongate member 3 to secure relative positions of the fins 2 on the strap 4 and prevent movement of the fins 2 relative to the strap 4 and elongate member 2. The position of each fin 2 on the strap is fixed by engagement between the strap 4 and the elongate member 3.

The length of the strap 4 may be longer than the circumference of the engagement portion 7 of the elongate member 3, or longer than a perimeter length of the engagement portion extending laterally around the engagement portion, so that one end of the strap overlaps an opposite end of the strap with the strap attached to the elongate member. The perimeter length extending laterally around the engagement portion is to be understood to be around a lateral section of the engagement portion orthogonal to the longitudinal axis of the elongate member. The outside surface of the strap may have a fastener half that is opposite to the fastener half on the inner side of the strap 4. The outside of the strap 4 has a corresponding fastener half opposite to the fastener half on the inside of the strap. For example, where the inside of the strap 4 has hooks of a hook and loop fastener, the outside of the strap has corresponding loops, to form a hook and loop fastener with the hooks of the inside of the strap. As the strap is longer than the circumference or perimeter of the engagement portion of the elongate member 3, with the strap 4 secured to the elongate member, one end of the strap overlaps an opposite end of the strap. With the strap wrapped around the engagement portion of the elongate member, an overlapping portion of the strap can wrap over the opposite end of the strap so that the inside of the overlapping portion of the strap 4 engages the outside of the opposite end of the strap 4, to further secure the strap around the engagement portion of the elongate member. In one embodiment, the fastener half covers substantially the full surface of the outside of the strap.

In some embodiments, the strap 4 is a strip of hook material and a strip of loop material bonded together back-to-back. Such material may be purchased in sheet form, such that the strap may be manufactured by simply stamping the strap from the sheet material comprising hook and loop materials boned back-to-back.

Figure 4:
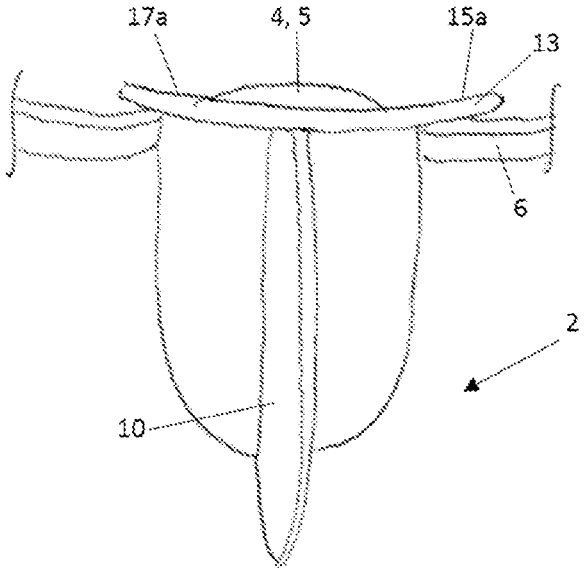
FIG. 4 is a top view of a fin of the device received on the strap of the device of FIG. 1.
Figure 7A:
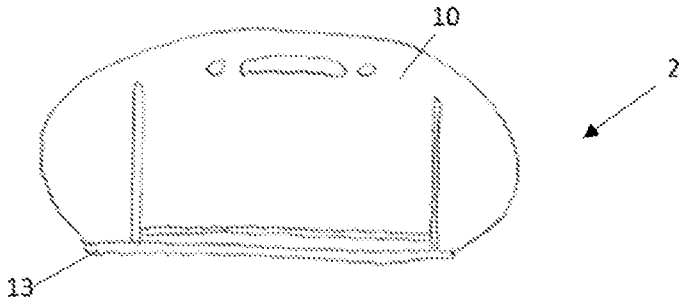
FIG. 7A. is a side view of a fin.
Figure 7B:
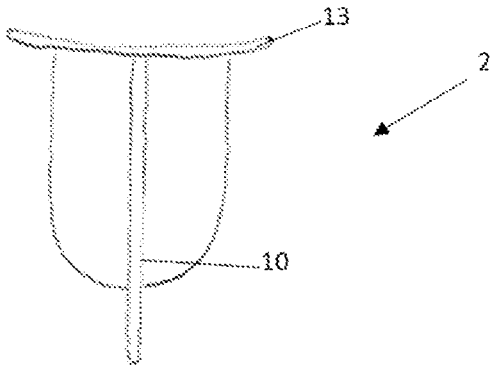
FIG. 7B. is a top view of a fin.
Figure 7C:
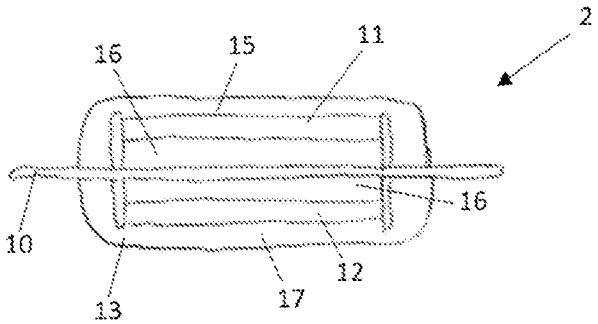
FIG. 7C is an end view of a fin.

With reference to FIGS. 7A to 7C, in the illustrated embodiment, each fin 4 has two apertures 11, 12 spaced apart (refer FIG. 7C), so that the strap 4 passes through a first aperture 11 and a second aperture 12 to receive the fin 2 on the strap 4. The fin 2 has a base 13 with the two spaced apart apertures, with the base configured similar to a tri-glide buckle, so that the strap 4 extends over a first lateral side member 15, through the first aperture, under a second (central) lateral member 16, through the second aperture, and over a third lateral member (a second side member) 17. The two side members 15, 17 and the central member 16 are arranged so that with the fin 2 received on the strap 4, the strap bends through the two apertures 11, 12 and across the central member 16 so that the inner surface of the strap 4 is proud of an inner surface 15*a*, 17*a* of each of the two side members 15, 17, as shown in FIG. 4. This arrangement of the side members 15, 17 and the central member 16 ensures a portion of the strap 4 located between the side members 15, 17 can contact the outer surface of the elongate member 3 to engage the fastener half on the elongate member 3. Adjacent fins 2 may be arranged close together long the strap 4, or even with the bases 13 of adjacent fins in contact. Engagement between the strap 4 and the elongate member 3 may therefore not be possible between adjacent fins 2 that are spaced close together. Engagement of the strap 4 with the elongate member 3 is predominantly achieved by the arrangement of the side members and central member described above, to ensure secure positioning of the fins 2 along the strap 4 so that the fins do not shift on the strap during use.

The fin 2 has a plate member 10 extending from the base 13. When the strap 4 is attached to the elongate member the plate 10 of each fin 2 extends approximately radially outwards from the elongate member. In use, when attached to the elongate member 3 the plate members 10 are arranged approximately parallel to a longitudinal axis of the elongate member 3 and therefore may be described as longitudinal fins.

In the illustrated embodiment, the fin 4 is a unitary component formed from a relatively rigid material, such as a relatively rigid plastic material. The fins may be injection moulded from plastic. A suitable material is ABS. The outer strap is flexible and may be formed from a fabric material such as a woven or webbing material. In the illustrated embodiment, the strap is non-extendable, i.e. the strap is not easily stretched by a user or is not elasticated.

Figure 5:
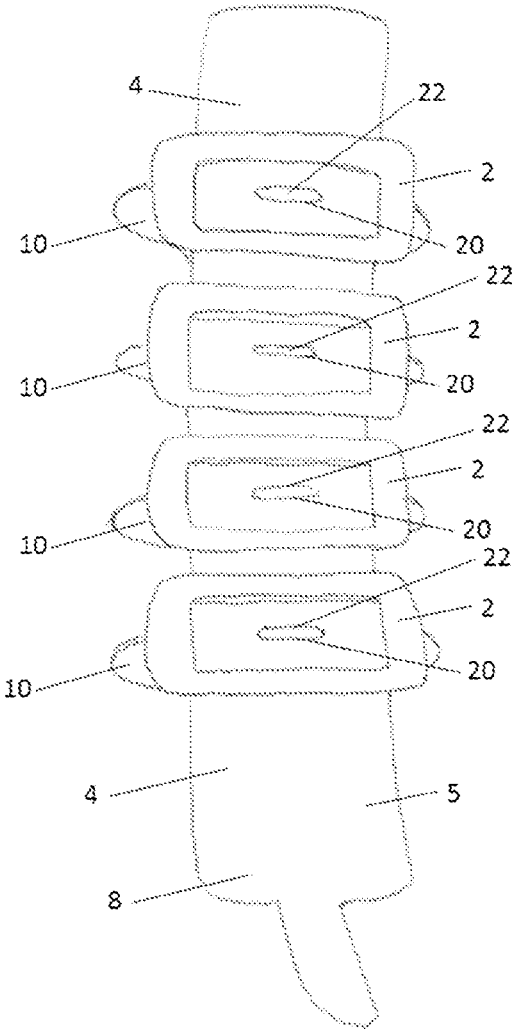
FIG. 5. shows four fins assembled to the strap viewed on an inner side of the strap.
Figure 6:
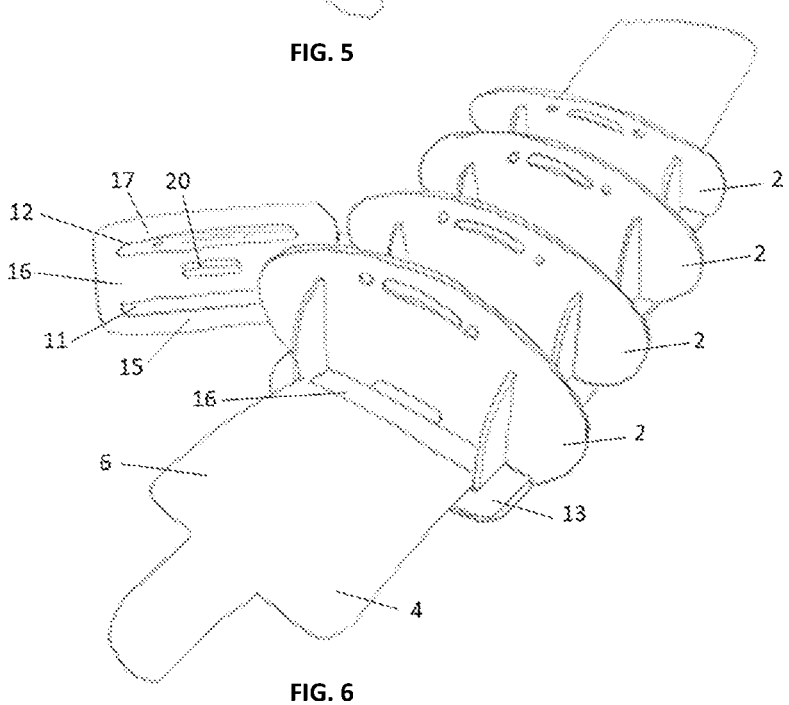
FIG. 6 shows another view of the fins and strap viewed from an outer side of the strap and including a fin with a bottom surface of a base of the fin visible.

The strap 4 may include indicators to indicate to a user a correct position to locate the fins on the strap 4. By correctly positioning the fins on the strap, the device can be configured to achieve desired properties in the water. For example, equi-spacing the fins can achieve an omni-directional fluid resistance during motion in water. The indicators may be markings, notches or apertures cut in or through the strap. For example, an indicator may comprise a pair of notches, each notch cut in an edge of the outer strap, and/or may comprise one or more holes (e.g. 2-5 mm diameter) cut through the strap 4. As shown in FIG. 5, in some embodiments, the indicator is a hole 20 cut in the strap 4. The indicators such as notches or holes may be aligned with a marking or one or more protrusions on the fin base that fit into the indicator notch or hole. A protrusion 22 can be seen on a fin 2 in FIG. 5. The protrusion 22 is located on the central member 16 of the base of the fin. As explained above, the two side members 15, 17 and the central member 16 of the fin base are arranged so that with the fin 2 received on the strap 4, the strap 4 bends through the two apertures 11, 12 and across the central member 16 so that the inner surface of the outer strap 4 is proud of an inner surface 15*a*, 17*a* of each of the two side members 15, 17 as shown in FIG. 4. The projection 22 is located on the central member and positively engages the hole 20 as the inner strap bends through the apertures 11, 12 and over the central member 16, to positively locate the fin on the strap 4.

In the illustrated embodiment, the strap 4 is separable from the elongate member 3, so that the strap 4 can be completely removed from the elongate member 3.

Figure 8:
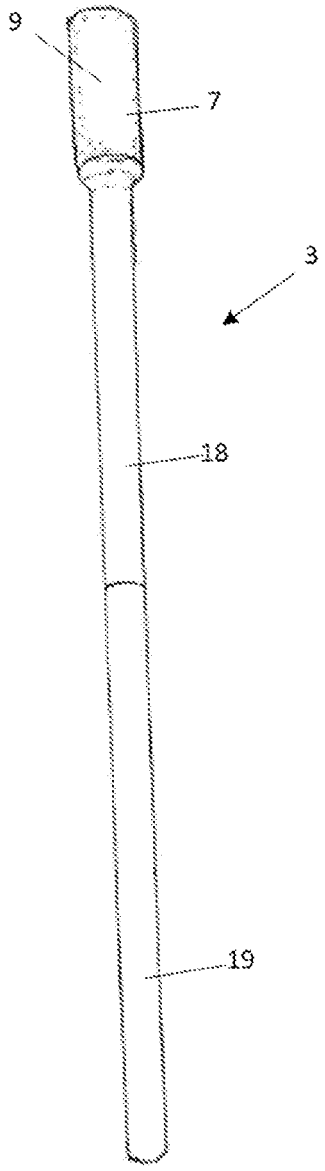
FIG. 8 shows an elongate member of the device of FIG. 1.
Figure 9:
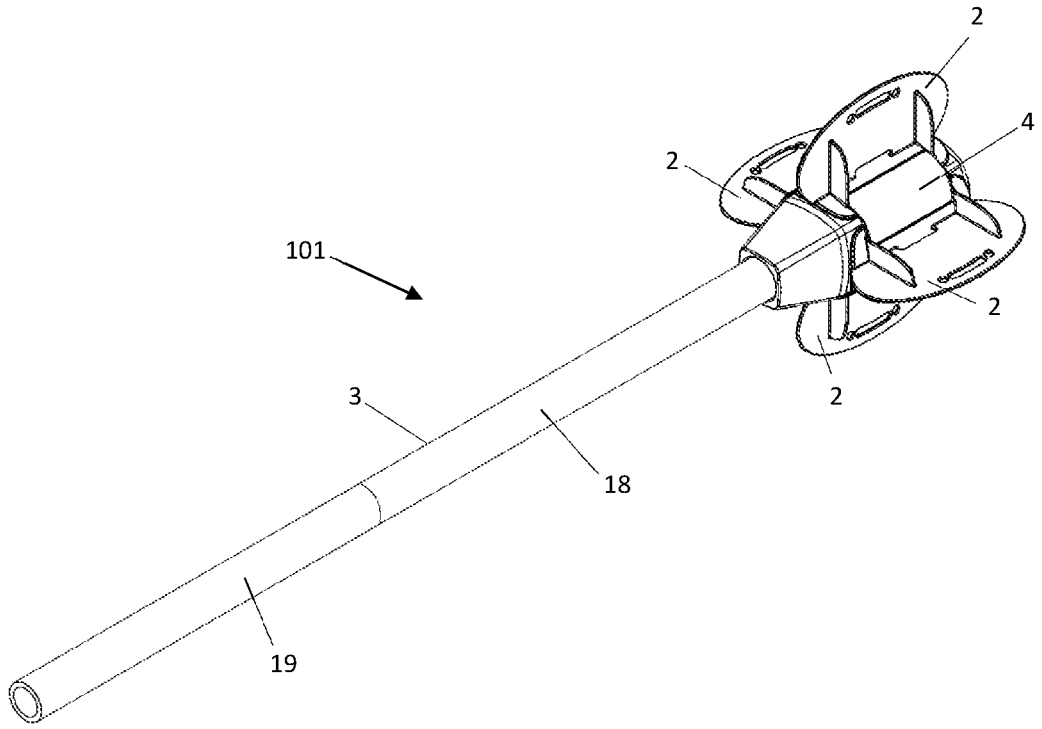
FIG. 9. shows an aqua resistance exercise device according to a second embodiment of the present invention.
Figure 10:
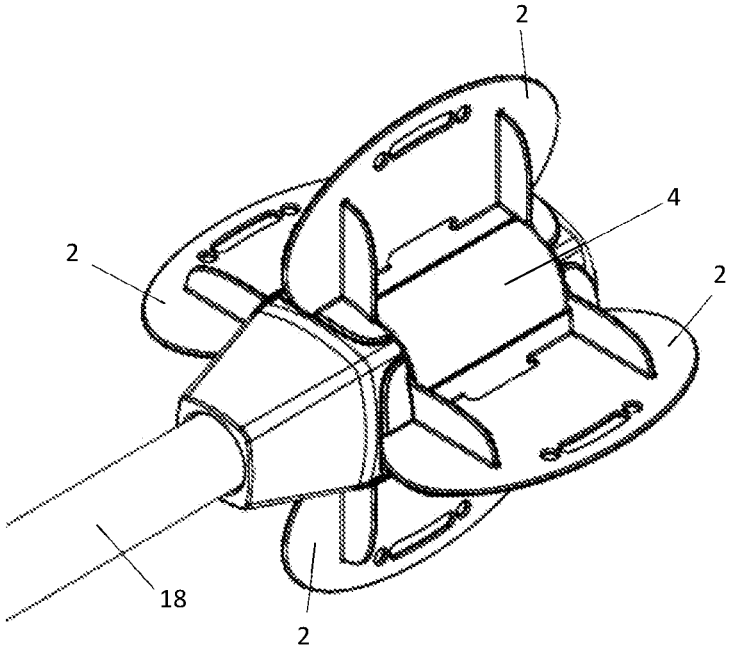
FIG. 10. shows an end region of the device of FIG. 9.
Figure 11:
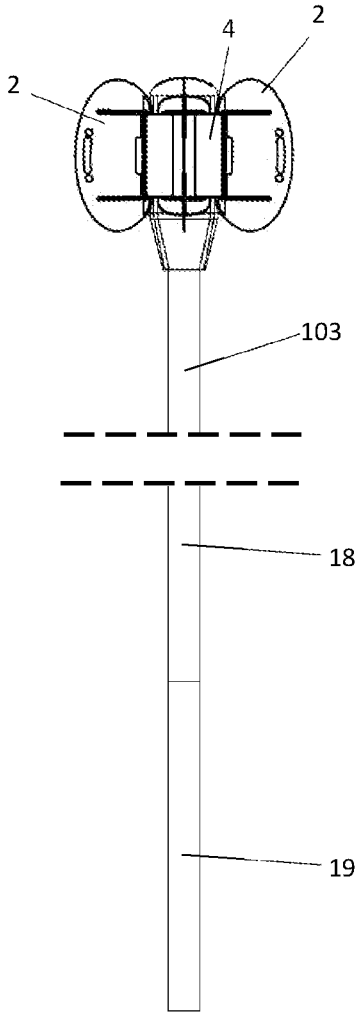
FIG. 11. is a side view of the device of FIG. 9. Break lines through the shaft of the device indicates the shaft is of an indeterminant length, i.e. the shaft may be shorter or longer than the illustrated length.

As shown in FIG. 8, the elongate member 3 comprises the engagement portion 7 at a distal end of the elongate member 3. A shaft 18 extends from the engagement portion 7 to be gripped by a user. The shaft replicates the shaft of an item of sporting equipment, such as a golf club, bat, racket and the like and may be of a similar length to the replicated sporting equipment. A handle 19 to be gripped by a user is provided at an end of the shaft 18 at an opposite proximal end (proximal to the user in use) of the elongate member 3. The handle may simply be an end region of the shaft.

In the illustrated embodiment, the elongate member 3 comprises an enlarged diameter engagement portion 7. The enlarged diameter engagement portion 7 has a diameter larger than a diameter of the shaft 18. The enlarged diameter portion 7 presents an enlarged surface area to which the strap 4 is attached, to provide a sufficient holding force between the strap 4 and the elongate member 3 to prevent relative movement between the strap 4 and the elongate member 3 and therefore prevent relative movement between the elongate member 3 and the fins 2 during use. The enlarged diameter portion also ensures a correct spacing of the fins 2 and allows for a plurality number of fins 2 to be attached to the elongate member. By example, the engagement portion of the elongate member may have a diameter or lateral dimension of approximately 60 mm. The shaft may have a diameter or lateral dimension of approximately 25 mm. The engagement portion has a lateral perimeter length that is greater than the lateral perimeter length of the shaft, such that the engagement portion presents an enlarged surface area to which the strap is attached to provide a sufficient holding force between the strap and the elongate member and therefore prevent relative movement between the elongate member 3 and the fins 2 during use. In the example embodiment, the surface area of the engagement portion is more than five times the surface area of the shaft for a given length.

In some embodiments the shaft of the elongate member is hollow. The hollow shaft may provide sufficient buoyancy in water such that the device 1 floats or is substantially neutrally buoyant. The device may be only slightly positively buoyant so that if the user drops the device in water it will rise to the surface. However, the buoyancy is not so great as to have a noticeable effect on the use of the device during exercise. The device may be substantially neutrally buoyant or slightly negatively buoyant, however the shaft may be positively buoyant, so that the device does not float, yet the shaft extends vertically in water when released.

An aqua resistance device 101 according to a second embodiment of the invention is described with reference to FIGS. 9 to 15. The same reference numerals appearing above in the description of the first embodiment of FIG. 1 are used to below to reference features that are the same or similar in both embodiments. The description provided above in relation to the first embodiment applies equally to the second embodiment in relation to the same or similar features.

Figure 15:
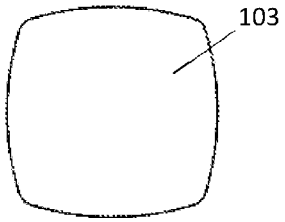
FIG. 15. is an end view of the elongate member of the device of FIG. 9.

In the first embodiment described above, the engagement portion 7 is cylindrical. In the second embodiment, and with particular reference to FIGS. 14 and 15, the elongate member 103 has an elongate engagement portion 107 with a cross-section or lateral profile with four sides. As shown in FIG. 15, the cross-section or lateral profile of the engagement portion 107 is approximately square, i.e. the sides are spaced equilaterally around the engagement portion. Each side of the engagement portion is curved with a curvature much greater than the diameter of the engagement portion. Adjacent sides are separated by a corner, wherein a curvature of each corner is much less than a curvature of each side. The elongate member 107 is otherwise the same as the elongate member 3 as described above. As described above with respect to the first embodiment, in the second embodiment, the engagement portion 107 is an enlarged diameter engagement portion 107. The enlarged diameter engagement portion 107 has a diameter or lateral dimension larger than a diameter or lateral dimension of the shaft 18. The enlarged diameter portion 107 presents an enlarged surface area to which the strap 4 is attached, to provide a sufficient holding force between the strap 4 and the elongate member 3 to prevent relative movement between the strap 4 and the elongate member 3 and therefore prevent relative movement between the elongate member 3 and the fins 2 during use. The enlarged portion 107 also ensures a correct spacing of the fins 2 and allows for a plurality of fins 2 to be attached to the elongate member. By example, the engagement portion 107 of the elongate member may have a diameter or lateral dimension of approximately 60 mm between and orthogonal to opposed sides of the engagement portion 107. The shaft may have a diameter or lateral dimension of approximately 25 mm. The engagement portion 107 has a lateral perimeter length that is greater than the lateral perimeter length of the shaft 18, such that the engagement portion 107 presents an enlarged surface area to which the strap is attached to provide a sufficient holding force between the strap 4 and the elongate member 3 and therefore prevent relative movement between the elongate member 3 and the fins 2 during use.

In the illustrated embodiment, the approximate square lateral profile of the engagement portion 107 presents four sides. Each side presents a position for securing a fin 2. Thus, the illustrated embodiment is suited for securing a maximum of four fins 2 to the elongate member, each side of the engagement portion corresponding to a fin. However, other 'polygon' lateral profiles are possible, to suit an alternative maximum number of fins. For example, the engagement portion may have an approximate triangular lateral profile, square profile, pentagon profile, or hexagon profile, suitable for securing a maximum number of three, four, five or six fins 2 respectively. The lateral profile is approximately a regular polygon, or in other words, the engagement portion has a plurality of sides equi-spaced around the longitudinal axis of the engagement portion.

Figure 12:
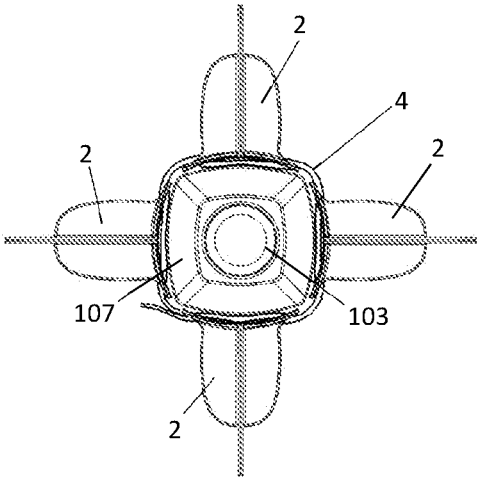
FIG. 12 is an end view of the device of FIG. 9.
Figure 13:
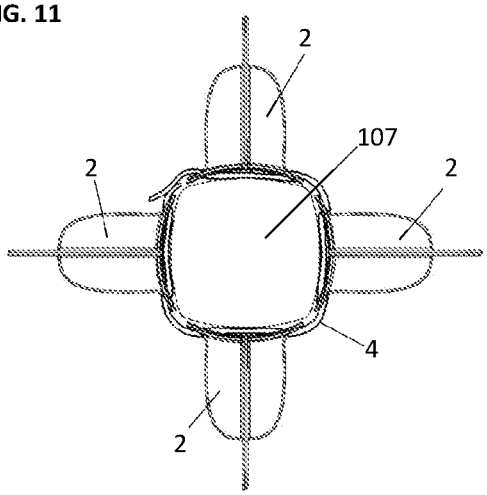
FIG. 13. is an opposite end view of the device of FIG. 9.
Figure 14:
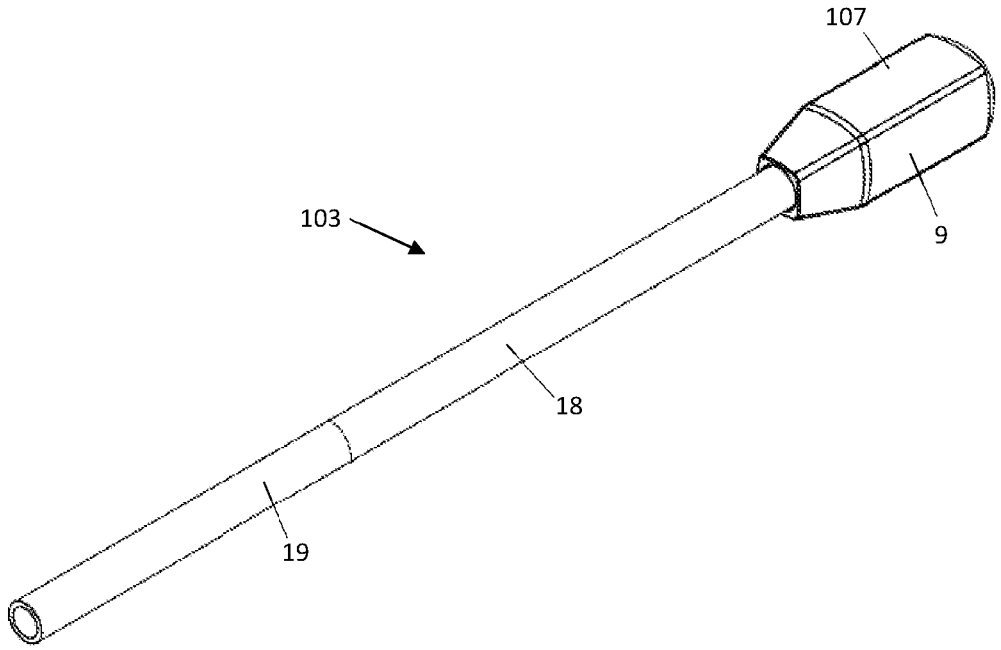
FIG. 14 shows an elongate member of the device of FIG. 9.

An engagement portion comprising a lateral profile presenting a plurality of sides may assist with securing the fins 2 to the elongate member, by preventing the fins from shifting circumferentially around the elongate member. Each fin is secured to a side of the engagement portion, and circumferential shifting of the fin is prevented since the fin cannot move over a corner of the profile without a significant lengthening of the strap secured around the engagement portion. Each fin has a base 13 as described above. The strap holds the base of each fin against a side of the engagement portion, as shown in FIGS. 9 to 13. As best shown in FIGS. 12 and 13, the base has a width corresponding substantially to the width of a side of the engagement portion. The base further assists in preventing the fins shifting circumferentially around the engagement portion 107, since the base cannot move over a corner of the lateral profile without a significant lengthening of the strap 4. In some embodiments, the base 13 of each fin 2 may have a shape commensurate with a shape of the side of the engagement portion. In the illustrated embodiment, the base has a curvature similar to the curvature of a side of the engagement portion. The curvature of a corner is much less than the curvature of a side and/or the curvature of the base of the fin.

Figure 16B:
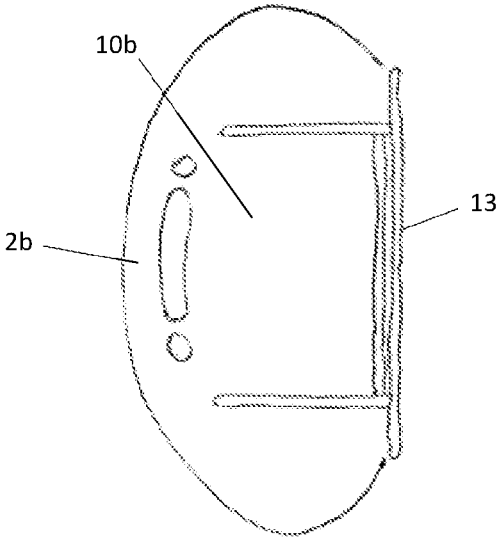
FIGS. 16A and 16B show two different size fins for the devices of FIGS. 1 and 9.
Figure 16A:
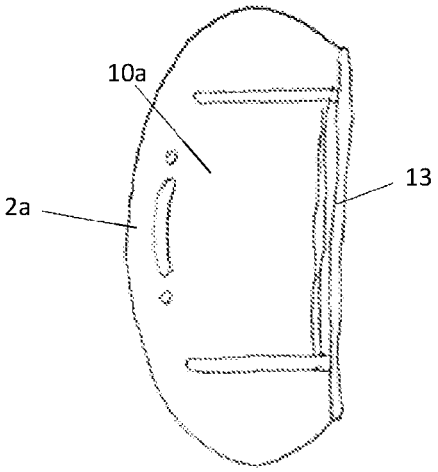

The device 1, 101 may be provided as an unassembled kit of parts, comprising the plurality of fins 2, the elongate member 3, and the strap 4. A kit of parts may be provided with a range of different fin sizes, for example, a small fin 2*a* and a large fin 2*b*, as shown in FIGS. 16A and 16B, respectively. The smaller fin has a smaller plate member 10*a* and the larger fin has a larger plate member 10*b*. However, the fins 2*a*, 2*b* have the same base member 13. A range of fins may comprise a small fin, medium fin and large fin, or more than 3 different sized fins. Alternatively, different sized fins may be purchased separately. A user wishing to alter the intensity of a workout may remove one size of fins from the strap and replace with a smaller or a larger set of fins, to achieve an easier or harder work out.

The invention may also be said broadly to consist in the parts, elements and features referred to or indicated in the specification of the application, individually or collectively, in any or all combinations of two or more of said parts, elements or features.

Aspects of the present invention have been described by way of example only and it should be appreciated that modifications and additions may be made thereto without departing from the scope thereof as defined in the appended claims.

The invention claimed is:

1. An aqua-resistance exercise device comprising:

an elongate member comprising an engagement portion, a shaft extending from the engagement portion, and a handle to be gripped by a user;

strap;

fasteners provided to the engagement portion of the elongate member and an inner side of the strap to releasably attach the strap to the engagement portion of the elongate member; and one or more fins adapted to be received on the strap;

wherein the fasteners releasably secure the strap to the engagement portion of the elongate member to thereby releasably secure the one or more fins to the elongate member.

2. The device as claimed in claim 1, wherein the fasteners releasably attach the strap to the engagement portion of the elongate member along substantially a full length of the strap.

3. The device as claimed in claim 1, wherein the fasteners are hook and loop type fasteners.

4. The device as claimed in claim 3, wherein hooks or loops of the hook and loop fasteners are applied over substantially the full surface of the inner side of the strap, and the other of the hooks or loops are is applied over substantially the full surface of the engagement portion of the elongate member.

5. The device as claimed in claim 1, wherein the length of the strap is longer than a circumference or a lateral perimeter length of the engagement portion of the elongate member so that one end of the strap overlaps an opposite end of the strap when the strap is wrapped around and attached to the engagement portion of the elongate member; and a first fastener is provided to an inner side of the strap, and a corresponding opposite second fastener is provided to an outer side of the strap, so that the inner side of an overlapping portion of the strap is releasably attached to the outer side of the strap when the strap is wrapped around and attached to the engagement portion of the elongate member.

6. The device as claimed in claim 5, wherein hooks or loops of the hook and loop fasteners are applied over substantially the full surface of the inner side of the strap, and the other of the hooks or loops are is applied over substantially the full surface of the outer side of the strap.

7. The device as claimed in claim 1, wherein the engagement portion of the elongate member is an enlarged diameter portion with a diameter larger than a diameter of the shaft.

8. The device as claimed in claim 1, wherein the engagement portion comprises a lateral profile presenting a plurality of sides.

9. The device as claimed in claim 8, wherein the sides are equi-spaced around a longitudinal axis of the engagement portion.

10. The device as claimed in claim 8, wherein each side presents a position for securing a respective fin.

11. The device as claimed in claim 8, wherein each fin has a base with a width corresponding substantially to a width of a side of the engagement portion.

12. The device as claimed in claim 8, wherein each fin has a base having a shape commensurate with a shape of a side of the engagement portion.

13. The device as claimed in claim 1, wherein the device comprises a plurality of fins, and wherein the strap, engagement portion of the elongate member and the fasteners are configured so that one fin of the plurality of fins may be attached to the elongate member, or all fins of the plurality of fins may be attached to the elongate member, such that a user may choose a number of fins from the plurality of fins to attach to the elongate member to provide a desired resistance level.

14. The device as claimed in claim 1, wherein each fin comprises a base and a longitudinal fin extending from the base, and wherein the base comprises a first aperture and a second aperture spaced apart in a longitudinal direction of the strap, so that the strap passes through the first aperture and the second aperture to receive the fin on the strap.

15. The device as claimed in claim 14, wherein the base comprises a first lateral side member, a central lateral member and a second lateral side member, the first aperture positioned between the first lateral side member and the central lateral side member, and the second aperture positioned between the central lateral member and the second lateral side member, and wherein a relative position of the central lateral member to the first and second lateral side members causes the strap to bend across the central lateral member so that the inner surface of the strap is proud of an inner surface of each of the first and second lateral side members to secure the strap to the engagement portion of the elongate member by said fasteners located between the first and second lateral side members.

16. The device as claimed in claim 1, wherein the strap is completely separable from the engagement portion of the elongate member.

17. The device as claimed in claim 1, wherein the strap is substantially non-extendable.

18. The device as claimed claim 1, wherein the shaft replicates the shaft of an item of sporting equipment.

19. A kit of parts for an aqua-resistance exercise device comprising:

an elongate member comprising an engagement portion, a shaft extending from the engagement portion, and a handle to be gripped by a user;

a strap;

fasteners provided to the engagement portion of the elongate member and an inner side of the strap to releasably attach the strap to the engagement portion of the elongate member; and one or more fins adapted to be received on the strap;

wherein the fasteners releasably secure the strap to the engagement portion of the elongate member to thereby releasably secure the one or more fins to the elongate member.

20. The kit of parts as claimed in claim 19, wherein the kit of parts comprises a range of different fin sizes, each to provide a different resistance level in water.

* * * * *